US008215450B2

(12) United States Patent
Chien

(10) Patent No.: US 8,215,450 B2
(45) Date of Patent: Jul. 10, 2012

(54) EXHAUST MUFFLER DEVICE

(76) Inventor: Chih-Chien Chien, Taipei (TW)

( * ) Notice: Subject to any disclaimer, the term of this patent is extended or adjusted under 35 U.S.C. 154(b) by 0 days.

(21) Appl. No.: 13/019,768

(22) Filed: Feb. 2, 2011

(65) Prior Publication Data

US 2011/0192677 A1 Aug. 11, 2011

(30) Foreign Application Priority Data

Feb. 5, 2010 (TW) ..... 99103519 A

(51) Int. Cl.
*F01N 1/08* (2006.01)

(52) U.S. Cl. ..... 181/269; 181/228; 181/212; 181/266; 181/272; 181/281

(58) Field of Classification Search ..... 181/269, 181/228, 212, 266, 272, 281, 230
See application file for complete search history.

(56) References Cited

U.S. PATENT DOCUMENTS

| | | | | |
|---|---|---|---|---|
| 1,402,896 A | | 1/1922 | Schneebeli | |
| 2,567,568 A | * | 9/1951 | Lievense et al. | 181/272 |
| 3,095,944 A | * | 7/1963 | Buxton | 181/246 |
| 4,192,403 A | * | 3/1980 | Nakagawa et al. | 181/268 |
| 4,595,073 A | * | 6/1986 | Thawani | 181/265 |
| 5,173,577 A | * | 12/1992 | Clegg et al. | 181/282 |
| 7,263,826 B2 | * | 9/2007 | Wu | 60/299 |
| 7,527,774 B2 | * | 5/2009 | Galligan | 423/213.2 |
| 2006/0113145 A1 | * | 6/2006 | Toyoshima et al. | 181/268 |

FOREIGN PATENT DOCUMENTS

| | | |
|---|---|---|
| DE | 736633 | 6/1943 |
| FR | 1441401 | 6/1966 |
| JP | 04043807 A * | 2/1992 |

OTHER PUBLICATIONS

European Search Report for EP11152675 issued on May 9, 2011.

* cited by examiner

*Primary Examiner* — Forrest M Phillips
(74) *Attorney, Agent, or Firm* — Banner & Witcoff, Ltd.

(57) ABSTRACT

An exhaust muffler device for an internal combustion engine includes an outer housing which defines a sealed chamber and which is connected to opposite inlet and outlet pipes, and an initial expansion subchamber and a pre-outlet subchamber disposed in the sealed chamber. The exhaust gas enters the initial expansion subchamber and mainly flows to a tubular passage in the pre-outlet subchamber to be exhausted through the outlet pipe. Portion of the exhaust gas flows into the sealed chamber and re-enters into a rejoining region of the tubular passage to be entrained in the main stream, thereby attenuating noise of the engine with minimal reduction of engine performance.

10 Claims, 4 Drawing Sheets

EXHAUST MUFFLER DEVICE

CROSS-REFERENCE TO RELATED APPLICATION

This application claims priority of Taiwanese Patent Application No. 099103519, filed on Feb. 5, 2010, the disclosure of which is herein incorporated by reference.

BACKGROUND OF THE INVENTION

1. Field of the Invention

This invention relates to an exhaust muffler device, more particularly to an exhaust muffler device used with an internal combustion engine.

2. Description of the Related Art

An exhaust muffler device is generally mounted between an exhaust manifold and a tailpipe of an internal combustion engine to reduce the noise generated by the engine as a result of the sudden expansion of combustion chamber exhaust gases. As disclosed in U.S. Pat. Nos. 6,089,347, 7,798,286 B2, and 7,243,757 B2, conventional mufflers are generally classified from the structural consideration as two basic types: a compartmentalized type which comprises a plurality of sealed, noise entrapment chambers, and a straight through muffler which comprises a perforated duct within a sealed housing. The compartmentalized type of muffler uses various volumes of different shaped or sized chambers interconnected with pipes and can dampen resonance frequency, but a relatively large volume of the chambers is required to generate resonation therein. The straight through muffler uses an offset side branch off a straight through pipe. When the sound wave reaches a closed end of the side branch, it reflects back to be dampened. However, an effect of the presence of reflector partitions and chamber walls is to produce a back pressure in the exhaust path of exhaust gas, which robs the engine of some amount of horsepower.

SUMMARY OF THE INVENTION

An object of the present invention is to provide an exhaust muffler device which can attenuate noise of the engine with minimal reduction of engine performance.

According to this invention, the exhaust muffler device includes an outer housing having inlet-side and outlet-side walls disposed to be spaced apart from each other in a longitudinal direction to define a sealed chamber. An inlet pipe extends through the inlet-side wall to permit entry of exhaust gas into the sealed chamber. An outlet pipe is disposed in the outlet-side wall and which extends along an outlet axis into the sealed chamber. An initial expansion subchamber is disposed in the sealed chamber, and has a first proximate wall disposed to permit the inlet pipe to extend therethrough, a first distal wall spaced apart from the first proximate wall in the longitudinal direction to serve as a barrier to obstruct flow path of main stream of the exhaust gas, and a first surrounding partition wall disposed between the first proximate and distal walls. A pre-outlet subchamber is disposed in the sealed chamber, and has a second proximate wall, a second distal wall spaced apart from the second proximate wall in the longitudinal direction to permit the outlet pipe to extend therethrough, and a second surrounding partition wall disposed between the second proximate and distal walls to define a tubular passage. The tubular passage has a direction change region which is juxtaposed to the first surrounding partition wall in a direction transverse to the longitudinal direction, and which is disposed downstream of the initial expansion subchamber by virtue of an internal port in the second surrounding partition wall that extends through the first surrounding partition wall, and a rejoining region which is disposed downstream of the direction change region and upstream of the outlet pipe, and which extends along the outlet axis of the outlet pipe. The second surrounding partition wall has a plurality of second communicating perforations such that portion of the exhaust gas from the main stream flowing out of the second communicating perforations at an upstream side into the sealed chamber is permitted to re-enter into the rejoining region through the second communicating perforations at a downstream side to be thereby entrained in the main stream before flowing out of the outlet pipe.

BRIEF DESCRIPTION OF THE DRAWINGS

Other features and advantages of the present invention will become apparent in the following detailed description of the preferred embodiments of the invention, with reference to the accompanying drawings, in which.

Before the present invention is described in greater detail, it should be noted that same reference numerals have been used to denote like elements throughout the specification.

DETAILED DESCRIPTION OF THE PREFERRED EMBODIMENTS

Figure 1:
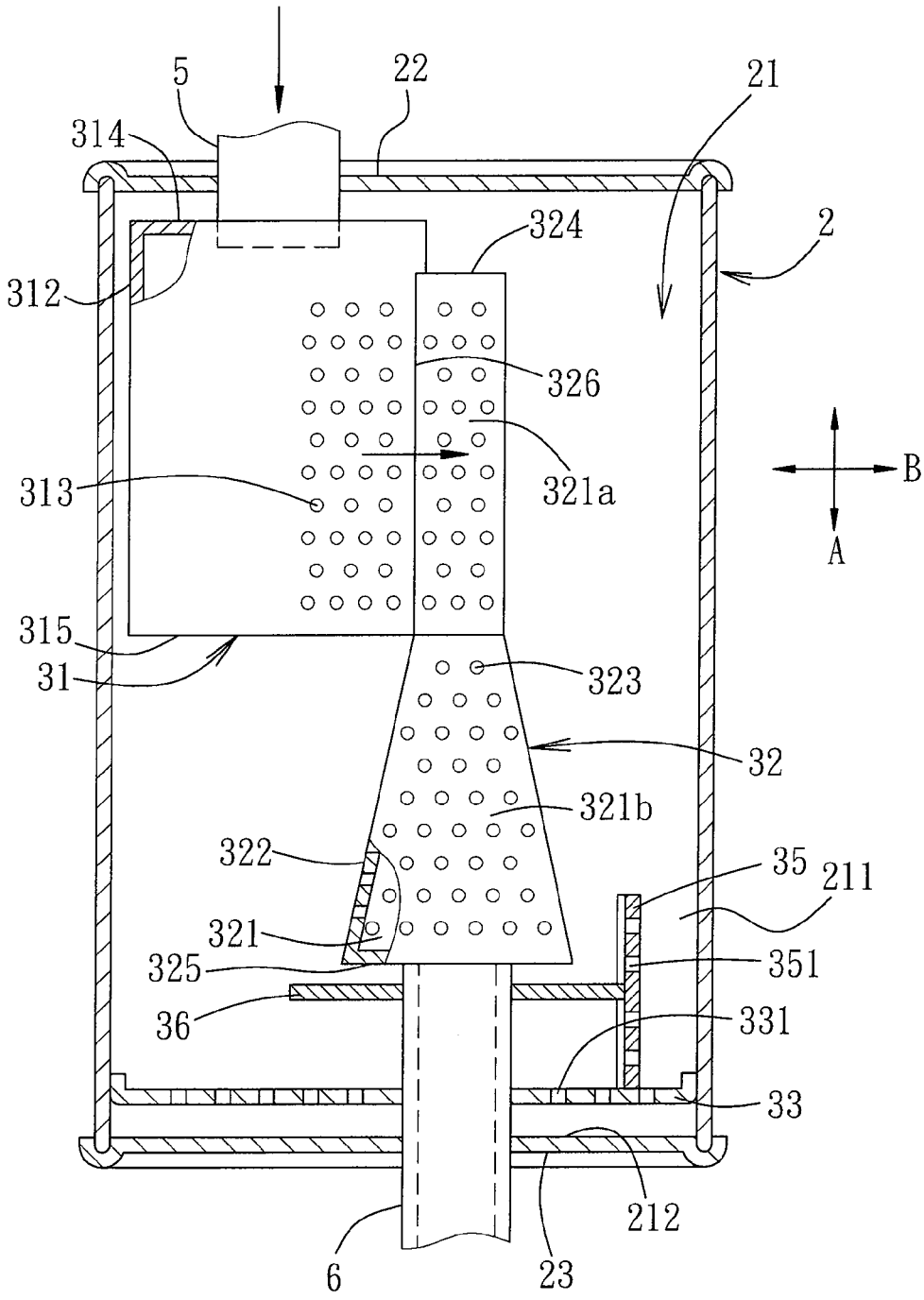
FIG. 1 is a sectional view of the first preferred embodiment of an exhaust muffler device according to this invention.

Before the present invention is described in greater detail, it should be noted that same reference numerals have been used to denote like elements throughout the specification.

Referring to FIG. 1, the first preferred embodiment of an exhaust muffler device according to the present invention is shown to comprise an outer housing 2, an inlet pipe 5, an outlet pipe 6, an initial expansion subchamber 31, and a pre-outlet subchamber 32.

The outer housing 2 has inlet-side and outlet-side walls 22, 23 disposed to be spaced apart from each other in a longitudinal direction (A) to define a sealed chamber 21. The inlet pipe 5 extends along an inlet axis through the inlet-side wall 22 so as to permit entry of exhaust gas into the sealed chamber 21. The outlet pipe 6 is disposed in the outlet-side wall 23 and which extends along an outlet axis into the sealed chamber 21. In this embodiment, the inlet axis is offset from the outlet axis.

The initial expansion subchamber 31 is disposed in the sealed chamber 21, and has a first proximate wall 314 which is spaced apart from the inlet-side wall 22 by a first distance, and which is disposed to permit the inlet pipe 5 to extend therethrough, a first distal wall 315 which is spaced apart from the first proximate wall 314 in the longitudinal direction (A) to serve as a barrier to obstruct flow path of main stream of the exhaust gas, and a first surrounding partition wall 312 which is disposed between the first proximate wall 314 and the first distal wall 315. The first surrounding partition wall 312 has a plurality of first communicating perforations 313 disposed downstream of the inlet pipe 5 and upstream of the first distal wall 315 to divert portion of the exhaust gas from the main stream out of the initial expansion subchamber 31 into the sealed chamber 21 so as to reduce the back pressure generated in the initial expansion sub-chamber 31.

The pre-outlet subchamber 32 is disposed in the sealed chamber 21, and has a second proximate wall 324 which is spaced apart from the inlet-side wall 22 by a second distance that is longer than the first distance, a second distal wall 325 which is spaced apart from the second proximate wall 324 in the longitudinal direction (A), and which is disposed to permit the outlet pipe 6 to extend therethrough, and a second surrounding partition wall 322 which is disposed between the second proximate wall 324 and the second distal wall 325 to define a tubular passage 321. The tubular passage 321 is configured to have a direction change region (321*a*) which is juxtaposed to the first surrounding partition wall 312 in a direction (B) transverse to the longitudinal direction (A), and which is disposed downstream of the initial expansion subchamber 31 by virtue of an internal port 326 in the second surrounding partition wall 322 that extends through the first surrounding partition wall 312, and a rejoining region (321*b*) which is disposed downstream of the direction change region (321*a*) and upstream of the outlet pipe 6, and which extends along the outlet axis of the outlet pipe 6. The second surrounding partition wall 322 has a plurality of second communicating perforations 323. In this embodiment, the second surrounding partition wall 322 at the rejoining region (321*b*) is configured to diverge toward the second distal wall 325 to permit further expansion of the main stream of the exhaust gas while flowing out of the outlet pipe 6.

Further, an outer partition wall 33 is disposed to divide the sealed chamber 21 into a proximate subchamber 211 bordered by the inlet-side wall 22 and a distal subchamber 212 bordered by the outlet-side wall 23. The outer partition wall 33 having a plurality of penetrating holes 331 communicating the proximate subchamber 211 with the distal subchamber 212. The initial and pre-outlet subchambers 31, 32 are disposed in the proximate subchamber 211. Furthermore, in this embodiment, a reflecting plate 36 is disposed in the proximate subchamber 211 between the second distal wall 325 and the outer partition wall 33 and parallel to the outer partition wall 33, and a perforated plate 35 is disposed to extend in the longitudinal direction (A) from the outer partition wall 33 to suspend the reflecting plate 36 from the outer partition wall 33. Thus, portion of the exhaust gas in the sealed chamber 21 is obstructed and reflected to permit an increased portion of exhaust gas in the sealed chamber 21 to re-enter into the rejoining region (321*b*) through the second communicating perforations 323 at the downstream side so as to facilitate flowing of the exhaust gas out of said outlet pipe 6. By virtue of the perforated plate 35 and the reflecting plate 36, vibration of the outer partition wall 33 generated as a result of impact of the flow of the exhaust gas in the sealed chamber 21 can be reduced.

The high-pressurized exhaust gas is led to enter into the initial expansion subchamber 31 for expansion while portion of the exhaust gas from the main stream flows through the first communicating perforations 313 in the sealed chamber 21. The main stream of the exhaust gas subsequently flows in the tubular passage 321 for further expansion while portion of the exhaust gas in an upstream side from the main stream flows through the second communicating perforations 323 into the sealed chamber 21. The exhaust gas in the sealed chamber 21 is permitted to re-enter into the rejoining region (321*b*) through the second communicating perforations 323 at a downstream side to be thereby entrained in the main stream before flowing out of the outlet pipe 6. The initial expansion subchamber 31 can serve as a resonating chamber to produce a sound wave that cancels out a certain frequency of sound. The sealed chamber 21 is also to serve as a resonating chamber where sound is reduced by reflecting and directing portions of the exhaust gas. By virtue of the pre-outlet subchamber 32 having the second communicating perforations 323, the exhaust gas can flow in and out the tubular passage 321 so as to generate destructive interference of sound. Meanwhile, after entering into the initial expansion chamber 31, the main stream of the exhaust gas can continue on flowing into the direction change region (321*a*) by being diverted in the transverse direction (B), and subsequently flow in the rejoining region (321*b*) for exhausting out of the outlet pipe 6. Thus, a smooth flow path of the main stream of the exhaust gas is produced from the inlet pipe 5 to the outlet pipe 6. In addition, by virtue of the first communicating perforations 313, the back pressure generated adjacent to the inlet pipe 5 can be further reduced. Accordingly, the drawback of decreasing in the output horsepower of an engine described in the prior art can be successfully eliminated.

Figure 2:
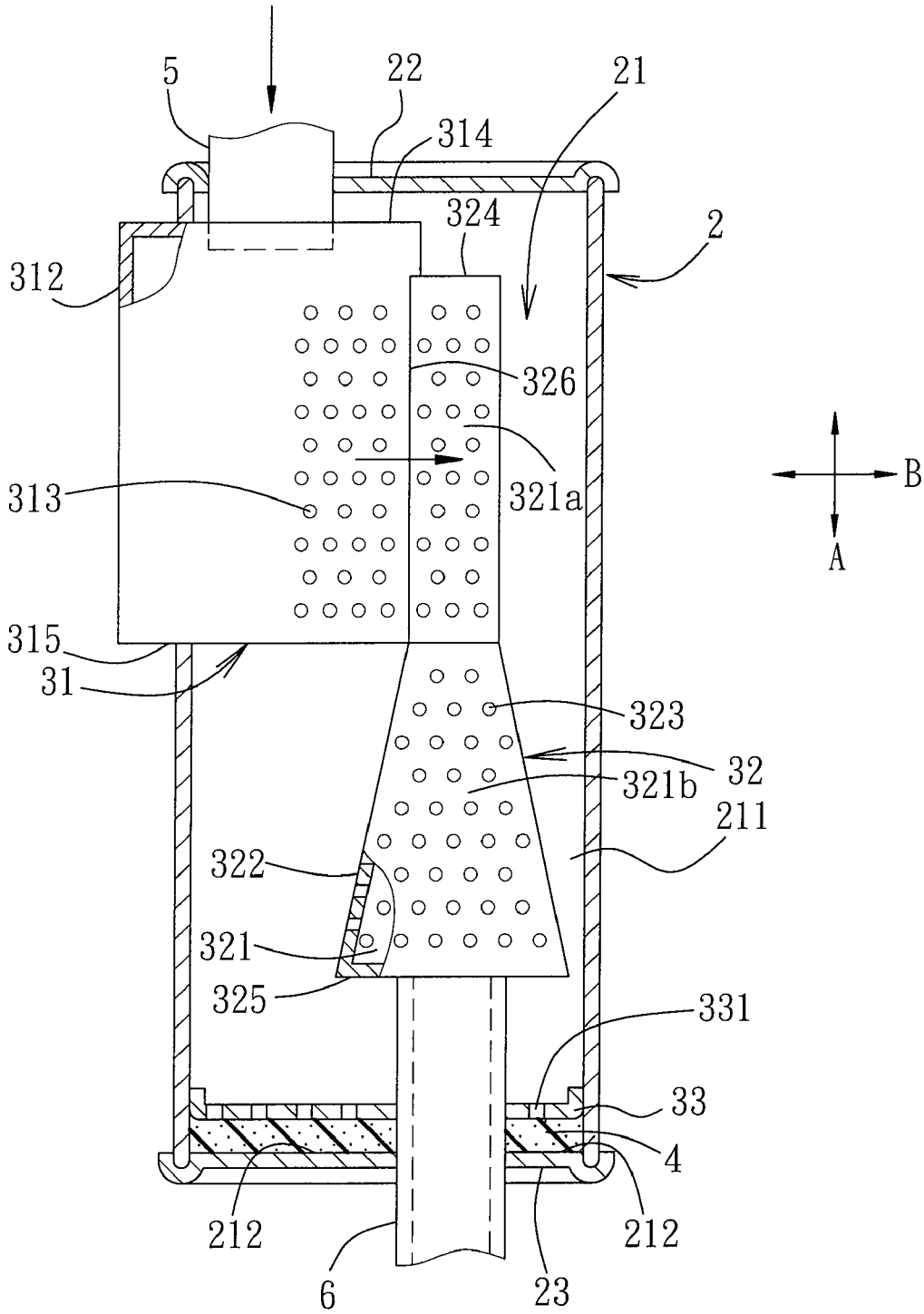
FIG. 2 is a sectional view of the second preferred embodiment of an exhaust muffler device according to this invention.

Referring to FIG. 2, the second preferred embodiment of the exhaust muffler device according to this invention is shown to be similar to the first preferred embodiment. In the second embodiment, an acoustic absorbing material 4 is further provided to be packed in the distal subchamber 212. In addition, part of the first surrounding partition wall 312 is disposed to extend transversely and outwardly of the outer housing 2 so as to minimize the volume of the sealed chamber 21, thereby reducing the accommodation space for the muffler device in a vehicle. This is particularly desirable if the muffler device is needed to be mounted under the middle part of the chassis of the vehicle.

Figure 3:
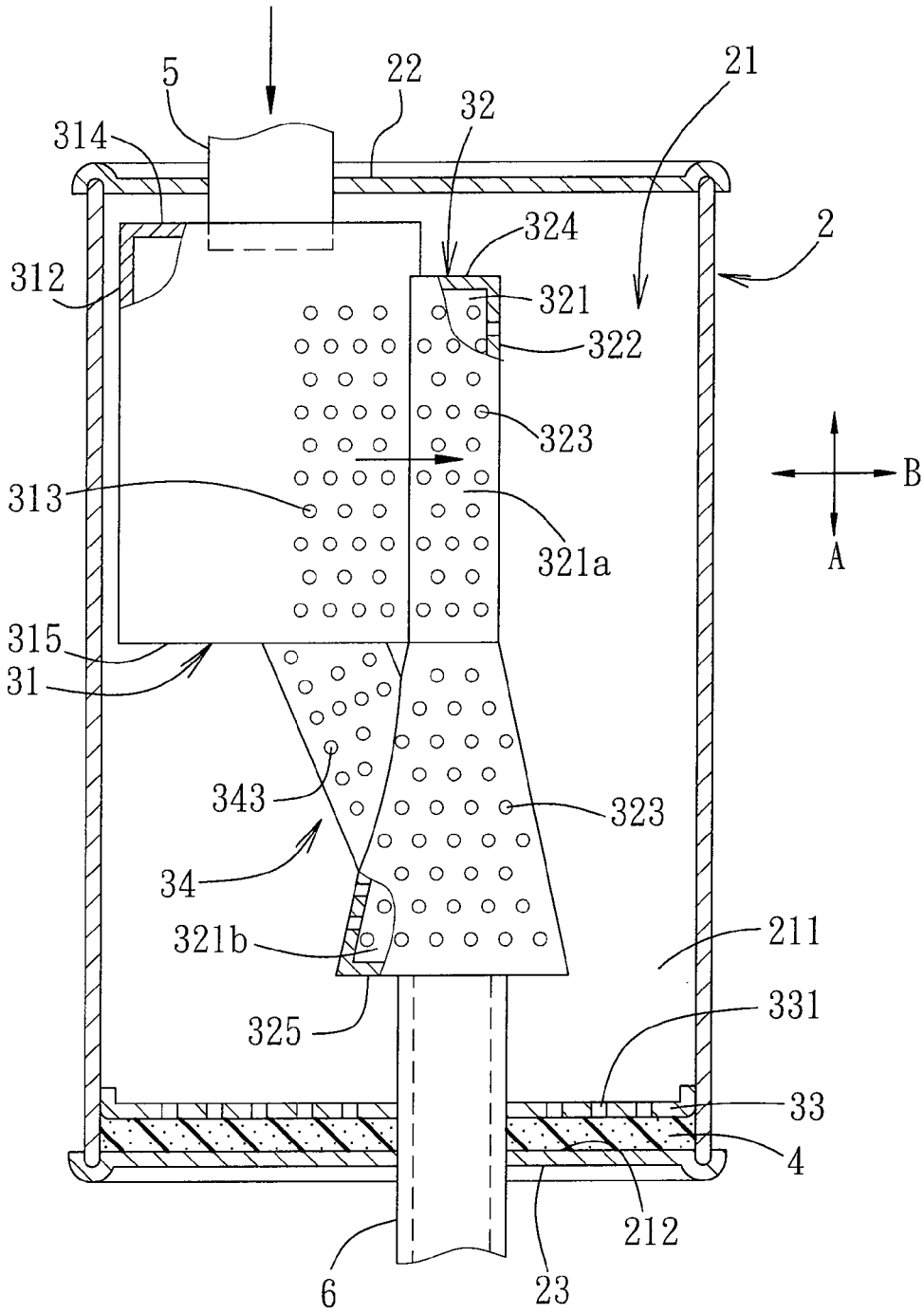
FIG. 3 is a sectional view of the third preferred embodiment of an exhaust muffler device according to this invention.

Referring to FIG. 3, the third preferred embodiment of the exhaust muffler device according to this invention is shown to be similar to the first preferred embodiment. In the third embodiment, a communicating subchamber 34 is further disposed in the sealed chamber 21 to communicate the initial expansion subchamber 31 with the rejoining region (321*b*) through the first distal wall 315 and the second surrounding partition wall 322 so as to permit portion of the main stream of the exhaust gas to pass through the communicating subchamber 34 and flow into the rejoining region (321*b*). The communicating subchamber 34 has a plurality of third communicating perforations 343 for further diversion of the exhaust gas into the sealed chamber 21.

Figure 4:
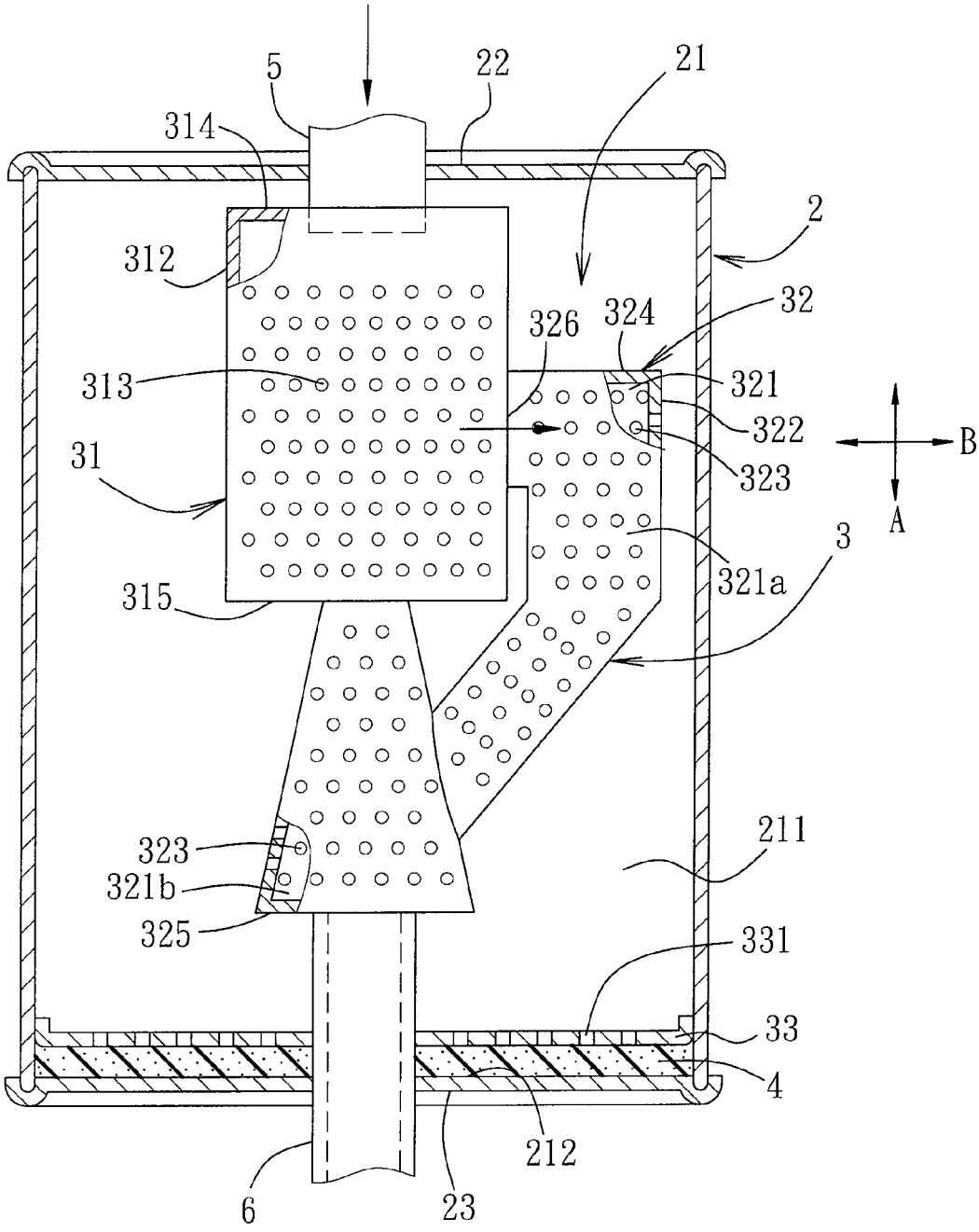
FIG. 4 is a sectional view of the fourth preferred embodiment of an exhaust muffler device according to this invention.

Referring to FIG. 4, the fourth preferred embodiment of the exhaust muffler device according to this invention is shown to be similar to the first preferred embodiment. In the third embodiment, the direction change region (321*a*) of the tubular passage 321 is pipe-like, and the rejoining region (321*b*) is in communication with the initial expansion subchamber 31 through the first distal wall 315 such that the inlet axis of the inlet pipe 5 is in line with the outlet axis of the outlet pipe 6 in the longitudinal direction (A).

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. An exhaust muffler device for reducing sounds associated with pressure waves of combustion gases exhausted from an internal combustion engine through an exhaust pipe, comprising:

an outer housing having inlet-side and outlet-side walls disposed to be spaced apart from each other in a longitudinal direction to define a sealed chamber;

an inlet pipe extending through said inlet-side wall so as to permit entry of exhaust gas into said sealed chamber;

an outlet pipe which is disposed in said outlet-side wall and which extends along an outlet axis into said sealed chamber, said exhaust muffler device further comprises:

an initial expansion subchamber disposed in said sealed chamber, and having a first proximate wall which is spaced apart from said inlet-side wall by a first distance, and which is disposed to permit said inlet pipe to extend therethrough, a first distal wall which is spaced apart from said first proximate wall in the longitudinal direction to serve as a barrier to obstruct flow path of main stream of the exhaust gas, and a first surrounding partition wall which is disposed between said first proximate wall and said first distal wall; and a pre-outlet subchamber disposed in said sealed chamber, and having a second proximate wall which is spaced apart from said inlet-side wall by a second distance, a second distal wall which is spaced apart from said second proximate wall in the longitudinal direction, and which is disposed to permit said outlet pipe to extend therethrough, and a second surrounding partition wall which is disposed between said second proximate wall and said second distal wall to define a tubular passage, said tubular passage being configured to have a direction change region which is juxtaposed to said first surrounding partition wall in a direction transverse to the longitudinal direction, and which is disposed downstream of said initial expansion sub-chamber by virtue of an internal port in said second surrounding partition wall that extends through said first surrounding partition wall, and a rejoining region which is disposed downstream of said direction change region and upstream of said outlet pipe, and which extends along the outlet axis of said outlet pipe, said second surrounding partition wall having a plurality of second communicating perforations such that portion of the exhaust gas from the main stream flowing out of said second communicating perforations at an upstream side into said sealed chamber is permitted to re-enter into said rejoining region through said second communicating perforations at a downstream side to be thereby entrained in the main stream before flowing out of said outlet pipe.

2. The exhaust muffler device according to claim 1, wherein said second surrounding partition wall at said rejoining region is configured to diverge toward said second distal wall to permit further expansion of the main stream of the exhaust gas while flowing out of said outlet pipe.

3. The exhaust muffler device according to claim 1, wherein the second distance is longer than the first distance, said first surrounding partition wall having a plurality of first communicating perforations that are disposed downstream of said inlet pipe and upstream of said first distal wall to divert portion of the exhaust gas from the main stream out of said initial expansion subchamber into said sealed chamber so as to reduce the back pressure generated in said initial expansion sub-chamber.

4. The exhaust muffler device according to claim 1, further comprising a communicating subchamber which is disposed to communicate said initial expansion subchamber with said rejoining region through said first distal wall and said second surrounding partition wall so as to permit portion of the main stream of the exhaust gas to pass through said communicating subchamber and flow into said rejoining region.

5. The exhaust muffler device according to claim 4, wherein said communicating subchamber has a plurality of third communicating perforations for further diversion of the exhaust gas into said sealed chamber.

6. The exhaust muffler device according to claim 1, further comprising an outer partition wall disposed to divide said sealed chamber into a proximate subchamber bordered by said inlet-side wall and a distal subchamber bordered by said outlet-side wall, said outer partition wall having a plurality of penetrating holes communicating said proximate subchamber with said distal subchamber, said initial and pre-outlet subchambers being disposed in said proximate subchamber.

7. The exhaust muffler device according to claim 6, further comprising an acoustic absorbing material packed in said distal subchamber.

8. The exhaust muffler device according to claim 6, further comprising a reflecting plate which is disposed in said proximate subchamber between said second distal wall and said outer partition wall and parallel to said outer partition wall, and a perforated plate which extends in the longitudinal direction from said outer partition wall to suspend said reflecting plate from said outer partition wall so as to reduce vibration of said outer partition wall generated as a result of impact of the flow of the exhaust gas in the sealed chamber.

9. The exhaust muffler device according to claim 1, wherein said inlet pipe extends along an inlet axis that is offset from the outlet axis of said outlet pipe.

10. The exhaust muffler device according to claim 1, wherein said rejoining region is in communication with said initial expansion subchamber through said first distal wall.

* * * * *